US006276456B1

(12) United States Patent
Head

(10) Patent No.: US 6,276,456 B1
(45) Date of Patent: Aug. 21, 2001

(54) RISER SYSTEM FOR SUB-SEA WELLS AND METHOD OF OPERATION

(76) Inventor: Philip Head, 178 Brent Crescent, Park Royal, London, NW10 7XR (GB)

( * ) Notice: Subject to any disclaimer, the term of this patent is extended or adjusted under 35 U.S.C. 154(b) by 0 days.

(21) Appl. No.: 09/244,241

(22) Filed: Feb. 3, 1999

(30) Foreign Application Priority Data

Feb. 6, 1998 (GB) ..... 9802591
Jun. 16, 1998 (GB) ..... 9812998

(51) Int. Cl.[7] ..... E21B 17/01

(52) U.S. Cl. ..... 166/359; 166/350; 166/367; 405/168.1; 405/168.3; 405/170; 405/224.2; 405/224.3

(58) Field of Search ..... 405/195.1, 224, 405/224.2–224.4, 168.1–168.4, 169, 170, 171, 155; 166/350, 359, 367

(56) References Cited

U.S. PATENT DOCUMENTS

| | | | | |
|---|---|---|---|---|
| 3,747,356 | * | 7/1973 | Lochridge et al. | 405/168.2 |
| 3,893,305 | * | 7/1975 | Walker | 405/168.1 |
| 4,225,270 | * | 9/1980 | Dareing | 405/168.1 |
| 4,325,434 | * | 4/1982 | Roberts | 166/321 |
| 4,367,967 | * | 1/1983 | Albert, Jr. | 138/110 X |
| 4,448,568 | * | 5/1984 | Gentry et al. | 405/169 |
| 4,556,340 | | 12/1985 | Morton . | |
| 4,647,255 | * | 3/1987 | Pow | 405/168.1 |
| 4,704,050 | * | 11/1987 | Wallace | 405/169 X |
| 4,730,677 | * | 3/1988 | Pearce et al. | 166/359 X |
| 4,735,267 | * | 4/1988 | Stevens | 166/350 X |
| 4,793,737 | * | 12/1988 | Shotbolt | 405/169 |
| 4,808,034 | * | 2/1989 | Birch | 405/195 |
| 4,854,781 | * | 8/1989 | Sparks et al. | 405/224 |
| 5,145,289 | * | 9/1992 | Titus | 405/169 |
| 5,380,129 | * | 1/1995 | Maloberti et al. | 405/168.1 X |
| 5,480,264 | * | 1/1996 | Hunter | 405/169 X |
| 5,738,464 | * | 4/1998 | Delrieu | 405/169 X |
| 5,749,676 | * | 5/1998 | Head | 405/171 |
| 5,791,695 | * | 8/1998 | Snider | 285/177 |
| 6,030,145 | * | 2/2000 | Stewart, Jr. et al. | 405/171 X |

FOREIGN PATENT DOCUMENTS

| | | | |
|---|---|---|---|
| 1 593 014 | | 7/1981 | (GB) . |
| 2 274 476 | | 1/1994 | (GB) . |
| 2297337 | * | 7/1996 | (GB) . |
| 2 320 268 | | 11/1997 | (GB) . |

* cited by examiner

*Primary Examiner*—David Bagnell
*Assistant Examiner*—Jong-Suk Lee
(74) *Attorney, Agent, or Firm*—Herbert Dubno

(57) ABSTRACT

A riser system connecting a oil or gas well head and a surface vessel comprises a first riser section maintained substantially vertically under tension, attached for example by a tension cable to a constant load tensioner means mounted on the vessel, and a flexible second riser section arranged above the first riser, the second riser being able to flex to accommodate movements in the surface vessel. The second riser section includes a curvature limiter, achieved for example by making the riser from a material of variable stiffness along the riser's length. An emergency disconnect valve is provided between the lower riser section and the upper flexible section. An alternative curvature limiter comprises a plurality of discrete collars which are connected together and surround the outer diameter of the second riser.

14 Claims, 14 Drawing Sheets

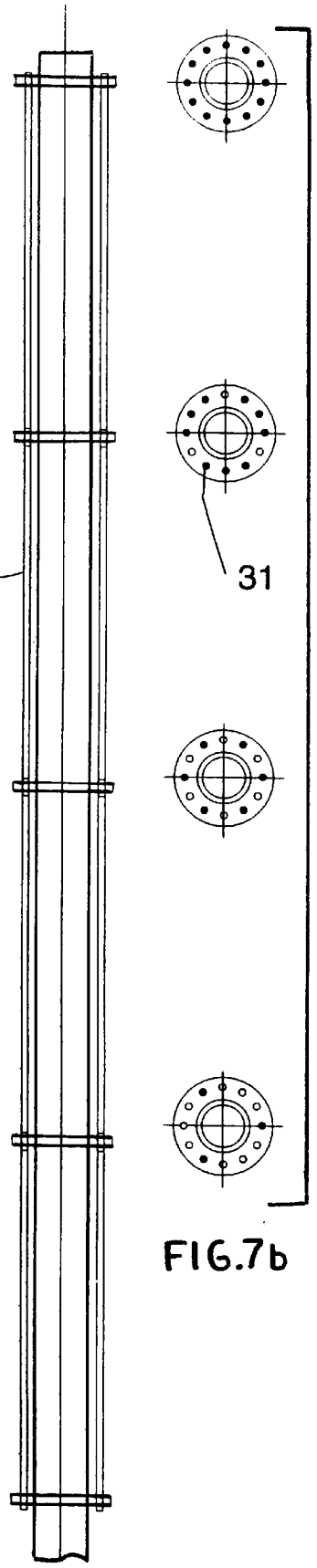
FIG.7a
FIG.7b
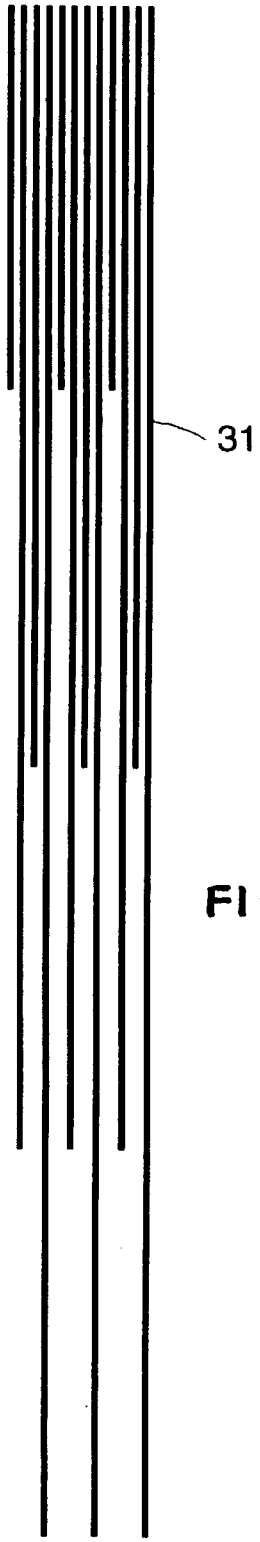
FIG.7c

RISER SYSTEM FOR SUB-SEA WELLS AND METHOD OF OPERATION

FIELD OF THE INVENTION

This invention relates to a riser system for accessing and servicing sub-sea oil or gas wells. The riser system may be used for production or to access an existing well to carry out intervention operations. Such access is required, for example, to take further measurements of the reservoir by introducing logging devices, for servicing or installation of electric submersible pumps to enhance production rates, replacing down-hole safety valves, cleaning out debris, zonal isolation re-perforating and for other reasons.

BACKGROUND OF THE INVENTION

Typically for a sub-sea production well, the original drilling platform will have been removed and the well head will have to be accessed by means of a suitable surface vessel. In order that the required operations can be carried out to the well, it is necessary that the movement of the vessel, which is floating on the surface of the sea, be compensated, to ensure positional consistency with respect to the well itself, which is fixed on the sea bed. This is conventionally provided by means of a heave compensation system on the vessel itself which is extremely cumbersome and expensive.

GB-A-2297337 is an example of a riser system which overcomes this problem and provides compensation for the heave and swell of the sea by a continuous coiled tubing riser which extends from the surface vessel to the well and which adopts a controlled 'S' profile which accommodates the movements of the surface vessel without these movements affecting the lower regions of the riser at the well head end. The disadvantage of this system is that the whole riser has to be made out of special grade materials in order to be sufficiently flexible, and this is expensive, in particular for wells which are located on a sea bed more than several hundred or several thousand feet below the sea level.

Other existing systems which involve fixed or semi-fixed platforms are expensive to install and maintain.

OBJECT OF THE INVENTION

It is an objective of the invention to provide a riser system which can be rapidly deployed to provide a conduit between the well head and a floating vessel, and which can be disconnected safely in the event of an emergency and without incurring damage to the system.

SUMMARY OF THE INVENTION

According to the invention there is provided an offshore oil or gas well riser system which forms a connection between the well head and a surface vessel, the riser system comprising a first riser section which extends substantially vertically and is maintained vertically under tension, and a second riser section which is flexible and is arranged above the first riser and flexes to accommodate movements in the surface vessel, the second riser section including curvature limiting means to limit the extent of curvature of the second section.

Preferably, the curvature limitation is provided by a variable stiffness along the length of the second riser. Thus starting from the vessel it will be relatively stiff so that the bending of the riser in the region of the vessel is limited and the stiffness decreases with the distance from the vessel along the second riser reaching a minimum stiffness approximately midway along the riser, increasing in stiffness again towards its junction with the first riser.

Preferably emergency disconnect means are provided between the lower riser section and the upper flexible section.

Preferably, tension may be induced in the lower riser by a tensile tie to the vessel, wherein a constant load tensioning means is provided to maintain constant tension. The lower riser will preferably be a coiled tubing riser which is lowered down from a coiled tubing reel.

The upper flexible section of the riser extends for a depth which is sufficient to accommodate the expected heave on the surface vessel. This will vary according to the sea or ocean conditions but is preferably between 30 and 150 meters.

The lower section preferably has a control valve at its upper end which may be closed when it is required to access the inside of the riser at the surface vessel. Such access will be required to lower different tools and instruments into the well and the upper end of the riser needs to opened for this purpose which exposes the well fluids to the surface vessel. Because this is potentially dangerous the well fluids are isolated by closing the control valve. The well fluids in the riser above the control valve can either be bled away after the valve has been closed or alternatively pressed back down the riser by an inert fluid before the control valve is closed. Preferably the control valve is a double ball valve.

The position of the vessel may be adjusted so that a smooth, continuous and sufficiently shallow curve is provided in the flexible upper section of the riser permitting equipment to be transmitted inside between the surface vessel and the well.

Preferably the second riser comprises a plurality of discrete collars which are connected together and surround the outer diameter of the second riser. The collars are connected together by connection means which permit a limited degree of relative axial movement which controls the radius of curvature of the second riser section.

Preferably the curvature control means of the second riser section has two states, a first state in which the second riser section is permitted to bend sufficiently to be wound on a reel and a second state in which the second riser section is permitted to bend only to a lesser extent.

Preferably activation means are provided on the vessel to convert the second riser section from the first state to the second state as the riser is unreeled from a reel.

There is also provided by the invention a method of installation of the well riser system which comprises the steps of;

a. positioning a vessel approximately over a well head in which well intervention operations are required to be carried out;
b. lowering a first lower riser section towards the well head;
c. connecting the second flexible upper riser section to the upper end of the first lower riser section to form a continuous riser;
d. connecting the first lower riser to a support line at its upper end and lowering it further to the well head and connecting it thereto preferably with the assistance of a remote vehicle and/or guide lines; and
e. activating curvature limiting means on the second riser section from a first state in which the second section is able to be wound on the reel to a second state in which the curvature is limited to a greater extent.

Alternatively, the curvature of the second flexible riser section is maintained at a radius of curvature which is sufficiently large to accommodate the passage of long tools therethrough and at the same time is permitted to flex to accommodate the movement of the vessel.

In the preferred embodiment of the invention a method and apparatus is provided which provides positional consistency between the well head and the vessel and permits intervention into the well from a surface vessel with pumps, measuring equipment, drilling equipment and other tools without the need for an expensive heave compensation system on the vessel. The apparatus and method according to the invention also ensures that there is no damage caused to the well head by bending moments applied by movement of the riser connecting it to the surface vessel.

The preferred embodiment of the invention accommodates itself between the well head and the moving boat by the flexing of the second riser section and it is also maintained rigidly above the well head which prevents any bending of the riser in this region which could damage the well head and the connection thereto.

BRIEF DESCRIPTION OF THE DRAWING

There is now described a detailed embodiment of the invention, in which the well riser system is shown being used for well intervention and the tubing is shown by way of example only as coiled tubing, with reference to the accompanying drawing in which:

FIGS. 7*a*, 7*b* and 7*c* show a longitudinal section, cross sections, and a diagrammatic view of the flexible riser shown in the embodiment of FIG. 4;

SPECIFIC DESCRIPTION

Figure 1:
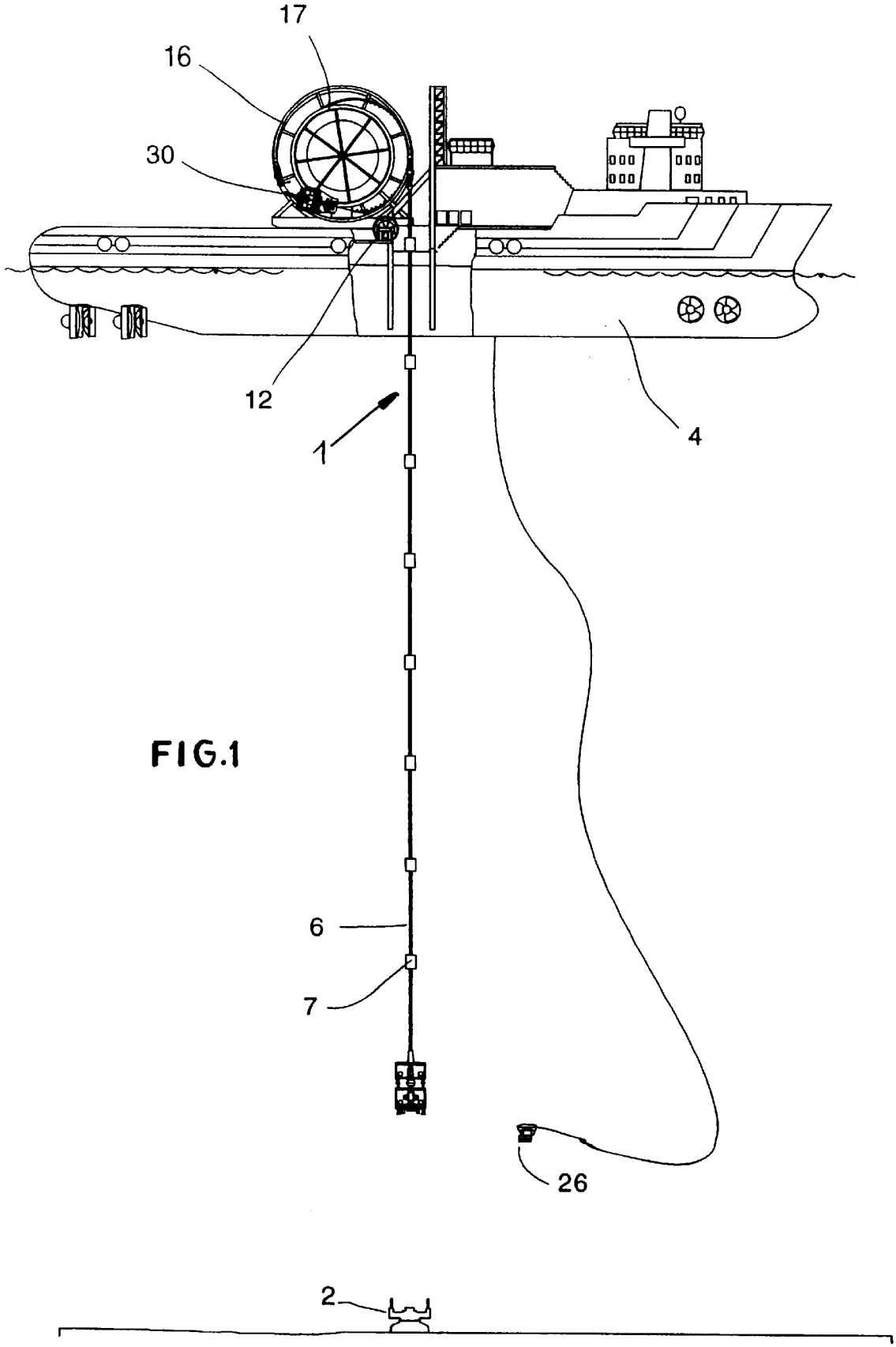
FIG. 1 and 2 are elevations of a riser system of the invention; showing the stages of the installation.
Figure 2:
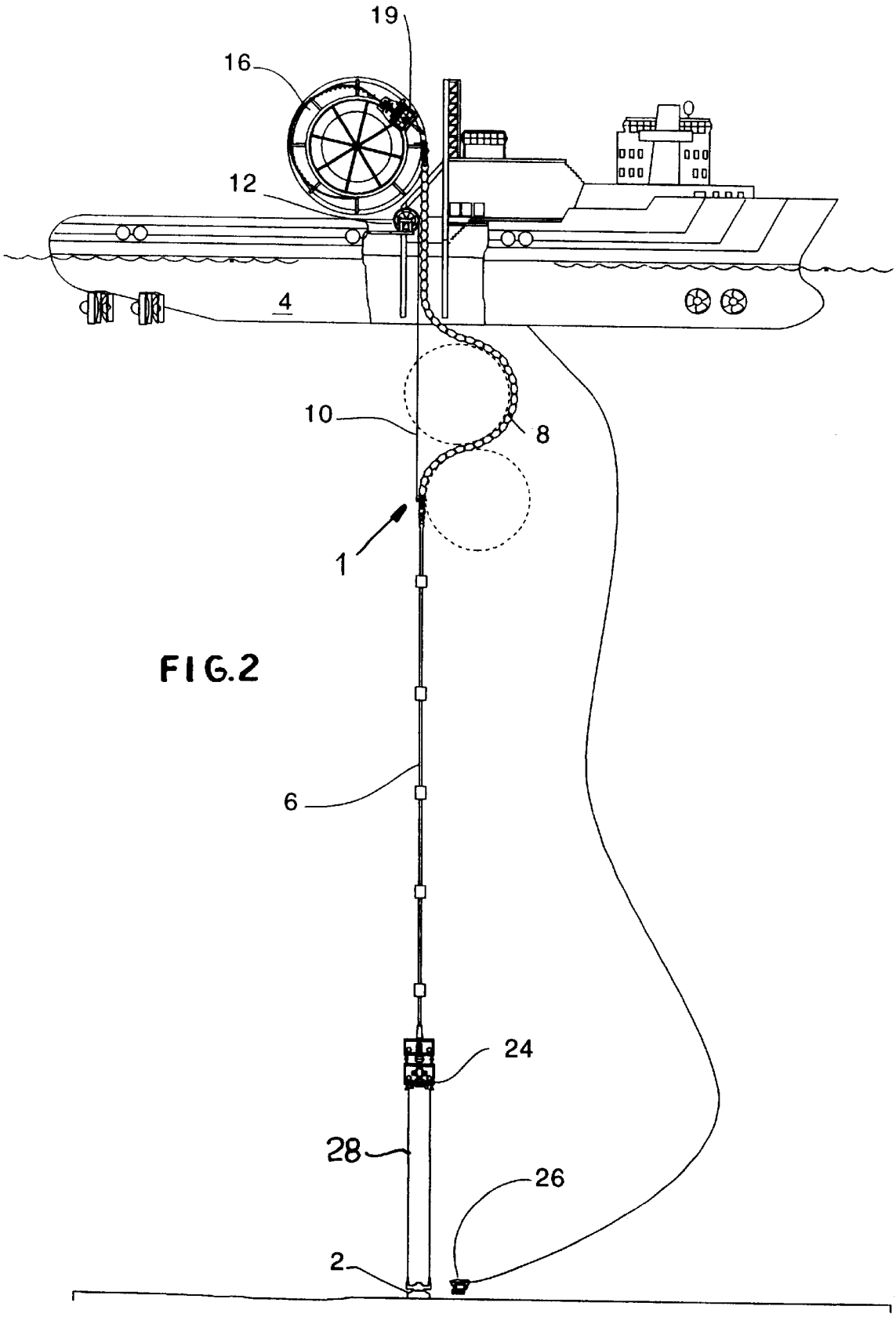

Referring to FIGS. 1 and 2 there is shown an offshore oil or gas well riser system 1 which forms a connection between the well head 2 and a surface vessel 4. The riser system 1 comprises a first lower riser section 6 which extends vertically, and a second upper riser section 8 which is made of a flexible material to accommodate movements in the surface vessel 4. Steel or another metallic coiled tubing could be used for the flexible section.

The main portion of the riser will be composed of coiled tubing, although it is also proposed to use a section of flexible armoured material for the riser section near the surface which will be most subject to the most extreme effects of the weather.

The surface vessel is intended to be any conveniently available vessel having dynamic positioning, such as a diving support vessel. A remotely operated vehicle (ROV) could be used to carry out many of the required sub sea manipulation tasks.

The lower riser section 6 is conveyed on a reel 16 on the vessel 4 and when unreeled is connected at its upper end to the vessel by a tie line 10 which is maintained in tension in order to support the weight of the lower section 6.

Referring to FIGS. 1 to 4 in sequence, the method of installation of the well riser system 1 can be followed.

Referring to FIG. 1, firstly the vessel is positioned in the desired location with respect to the well head in clear water.

The lower riser package 24 is positioned in the vessel ready for lowering, for example though a moon pool and is connected to the free end of the lower riser section which at this stage is stowed on a spool 16. The spool 16 comprising the lower riser section 6 is slid into position on the vessel and the lower riser section 6 is lowered into the water and towards the well head 2.

When this is complete the upper end of the lower riser section is released from the spool 16 and hung off at the exit of the vessel such as the moon pool. The tension line is then connected to the top of the lower riser section 6 and is connected to the vessel 4 at its upper end. Referring to FIG. 2, the bottom end of the upper flexible riser 8 is then connected to the top of the lower riser 6, and the flexible riser 8 and the support line 10 are unreeled from a reel and lowered towards the well head. The weight of the entire payload is taken by the tie line 10 so that the flexible riser section 8 is not damaged.

The lower end of the lower riser section 6 and the lower riser package 24 is connected to the well head 2. A remote vehicle, or guide lines 28 and corresponding guide posts on the well head, may be used to attach the lower riser to the well head. Using the pulling winches the lower riser package is latched onto the Christmas tree of the well head 2. The tie lines 10 are then tensioned to give the desired tension in the lower riser section. Alternatively, the lower end of the first riser section 6 may be stabbed directly into the well head 2 if the well head is provided with the required connection means and remote vehicle intervention is therefore not required.

The function and pressure test procedure is then carried out before proceeding with the well intervention operations.

In this embodiment an injector 19 is shown which may then be used to inject a further coiled tubing of narrower diameter then the internal diameter of the riser to carry out intervention operations.

The lower riser section 6 shown is a coiled tubing riser and constitutes the main section of the riser and when connected to the well head is essentially an extension of the well tubing. The tie line 10 is tensioned adjusted to hold the lower riser section 6 essentially vertically in tension under a constant pre-determined tension which is sufficient to maintain the riser vertically and to prevent bending in the riser causing damage to the riser itself or the well head or the connection between them. Constant load tensioning means 12 are provided on the vessel to maintain the tension line 10, and the first riser section, under constant tension. Alternatively a support buoyancy means may be used to support the lower riser section in tension. The support buoyancy means may be evacuated to provide an upward force on the lower riser section 6 and to the well head 2.

A lower riser package 24 is arranged at the lower end of the lower riser section 6. The lower riser package 24 comprises a tree blow out preventer (BOP) which is preferably a dual ram BOP which will be primarily used in the event of an emergency disconnect. The BOP will be capable of cutting the coiled tubing and retaining the pressure in the well thereby preventing any hydrocarbon release. A tree connector connects the existing Christmas tree of the existing well head 2 to the lower riser 6. Installation winches are also provided which are used to latch the lower riser package 24 to the Christmas tree at the tree connector.

The lower riser section 6 shown is a coiled tubing riser and constitutes the main section of the riser and is essentially an extension of the well tubing. The tie line 10 is tension adjusted to hold the lower riser section 6 essentially vertically in tension with an acceptable offset dependent upon the environmental conditions and the length of the section 6.

The lower riser section 6 is shown as a coiled tubing riser which is lowered down from a coiled tubing reel. It will be appreciated however that for the purposes of the invention the lower riser section could be provided by joined tubing.

A sub sea valve assembly may also be located at the top of the first riser section. This permits the deployment of tool strings into the flexible riser without the need to de-pressurise the coiled tubing riser 6. The valve assembly is also serves to seal the contents in the event of an emergency and will be able to shear through anything inside the riser in the event of an emergency.

Emergency disconnect means e. g. an emergency disconnect value are provided to enable disconnection from the lower riser section 6 in the event of an emergency. The disconnect operation would be sequenced with well pressure control devices to ensure that the well is made safe before the disconnect activates.

The upper flexible section 8 of the riser system 1 extends between the top of the first riser section and the vessel 4 for a depth which is sufficient to accommodate the expected heave on the surface vessel 4. This will vary according to the sea or ocean conditions but is preferably between 30 and 150 meters. This can be adjusted by the operation according to the prevailing conditions in the particular location in which the vessel is operating. Conveniently, this decision will be made before the vessel leaves shore and the required length of flexible tubing for the upper section and rigid tubing for the lower section, calculated according to the expected conditions at the location of the well, can be stowed on the vessel.

The position of the surface vessel 4 is preferably maintained essentially above the well head. The flexible riser section 8 has a controlled curvature so that a smooth continuous and sufficiently shallow curve is provided in the flexible upper section of the riser permitting equipment to be transmitted inside between the surface vessel 4 and the well 2. The curvature of the second riser section will be limited to the elastic limit of the material of the section riser section and preferably well within the elastic limit to provide a extended fatigue free life. The dotted circles illustrated in FIG. 2 represent a possible curvature limit imposed upon the upper riser.

Figure 3:
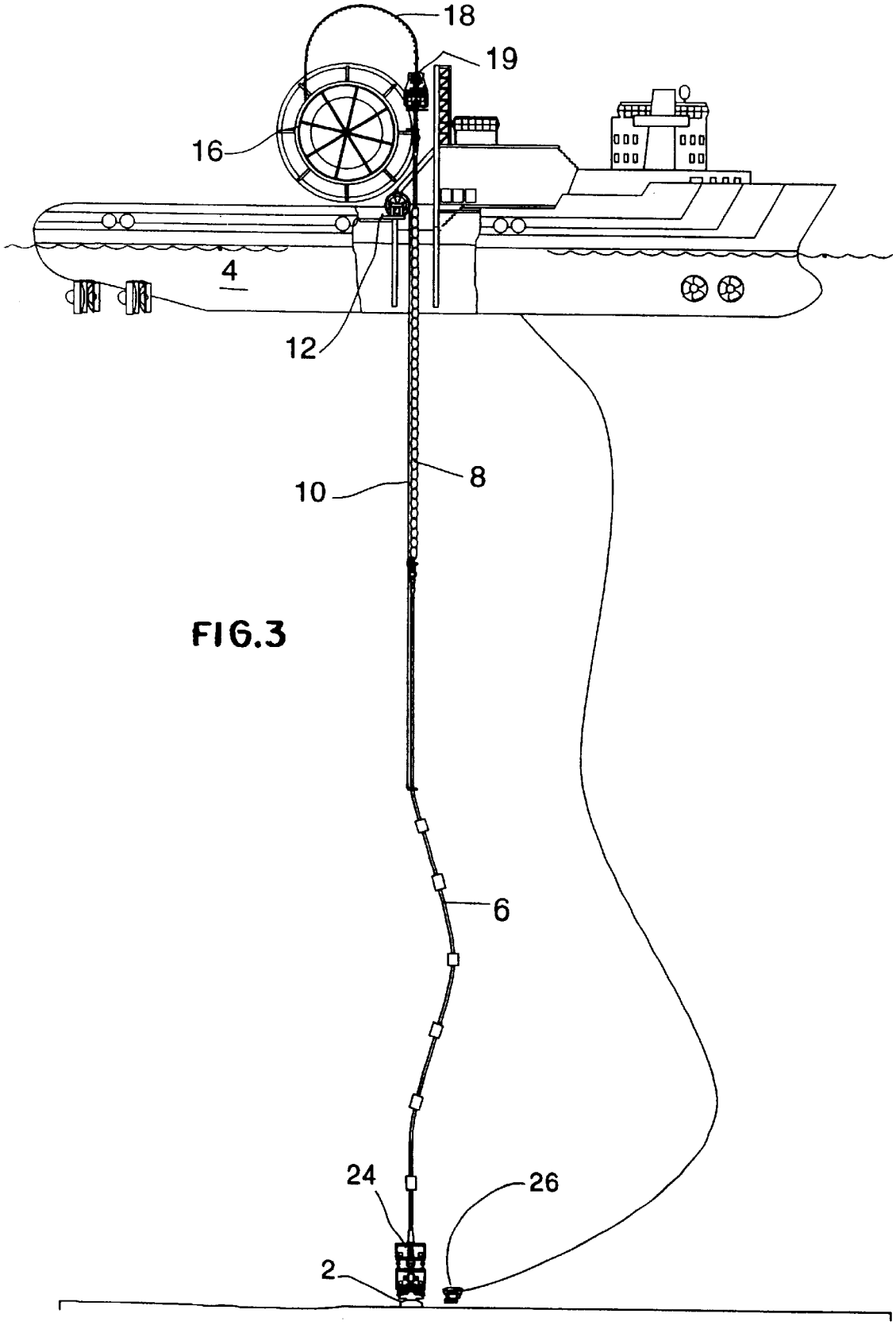
FIG. 3 is an elevation of a riser system of the invention during use showing one embodiment for the passage of long tools.

FIG. 3 shows the system in the operating position with intervention tubing provided on intervention reel 17, and arranged in a gooseneck 18 before entering an injector 19 and then entering the riser sections 6, 8. The intervention tubing will carry the required equipment, instruments and tools into the well. FIG. 3 shows one way of transferring long tools down the flexible riser section 8 which would otherwise be unable to pass the curvature in the flexible riser section 8. The tension in the tension line 10 is released which causes the lower riser section to flex. The lower riser section 6 will generally speaking preferably be made of a stiffer material than the upper riser section but the greater length of the lower riser section in such a case is sufficient to cause the lower riser section to fall sufficiently to straighten the upper riser section 8. Thus tools are now able to pass down the upper riser section 8. The heave of the vessel is accommodated by the flexing of the lower riser section 6. Buoys 7 are provided on the lower riser section 6 and by deflating the buoys 7 immediately above the well head 2 the lower riser section is maintained vertically in the region of the well head and any damage which would otherwise be cause by bending of the lower riser section is avoided.

In order to disconnect from the well head 2 in an emergency, lower riser section 6 is pulled clear of the well head by the tension in the tension line 10. The tensioning means is immediately de-activated to stop the lower riser section being pulled further up towards the vessel before the reels 16, 17 have taken up the slack in the upper riser section 8 and the intervention tubing.

Figure 4:
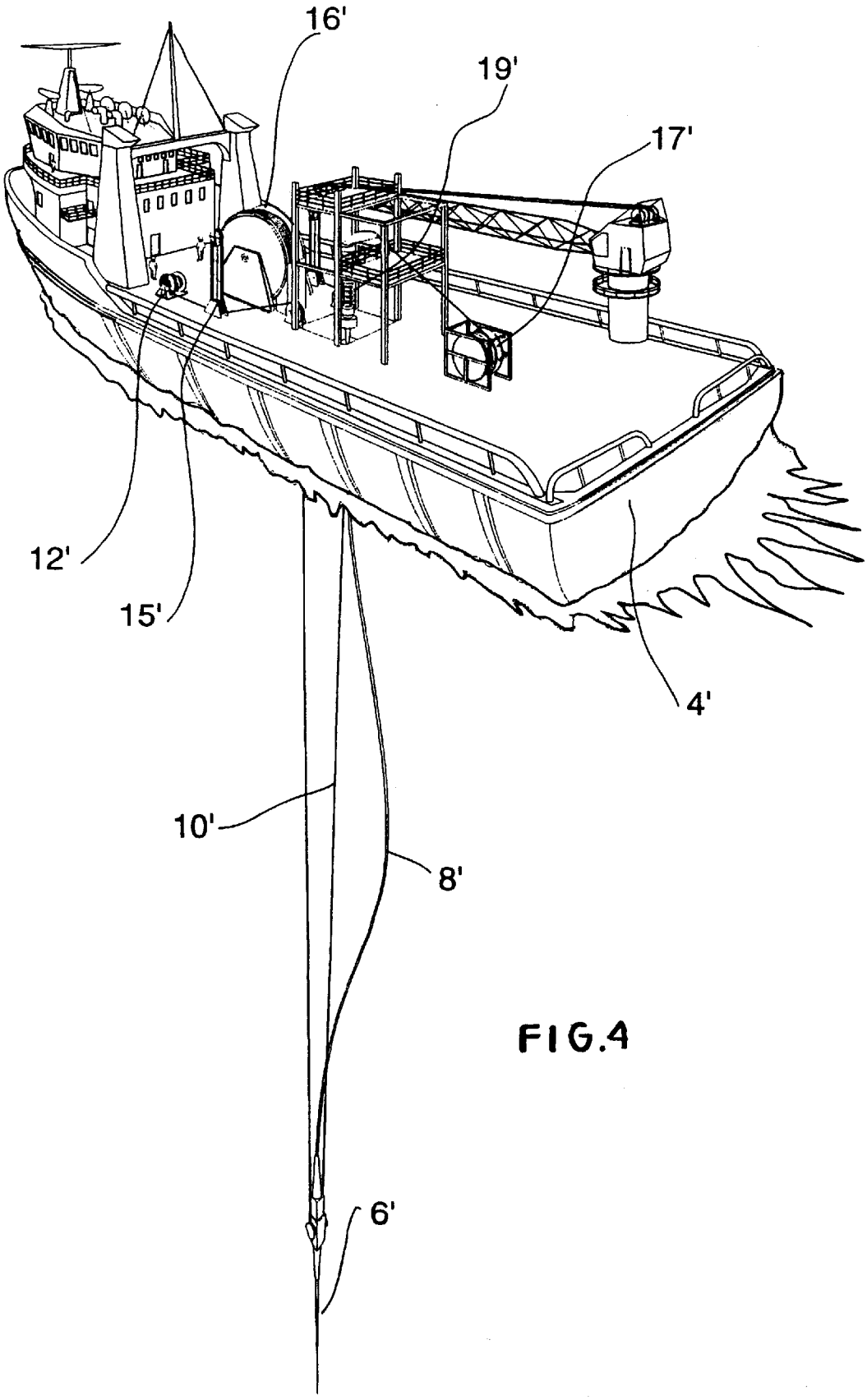
FIG. 4 is a perspective view of a riser system.
Figure 5:
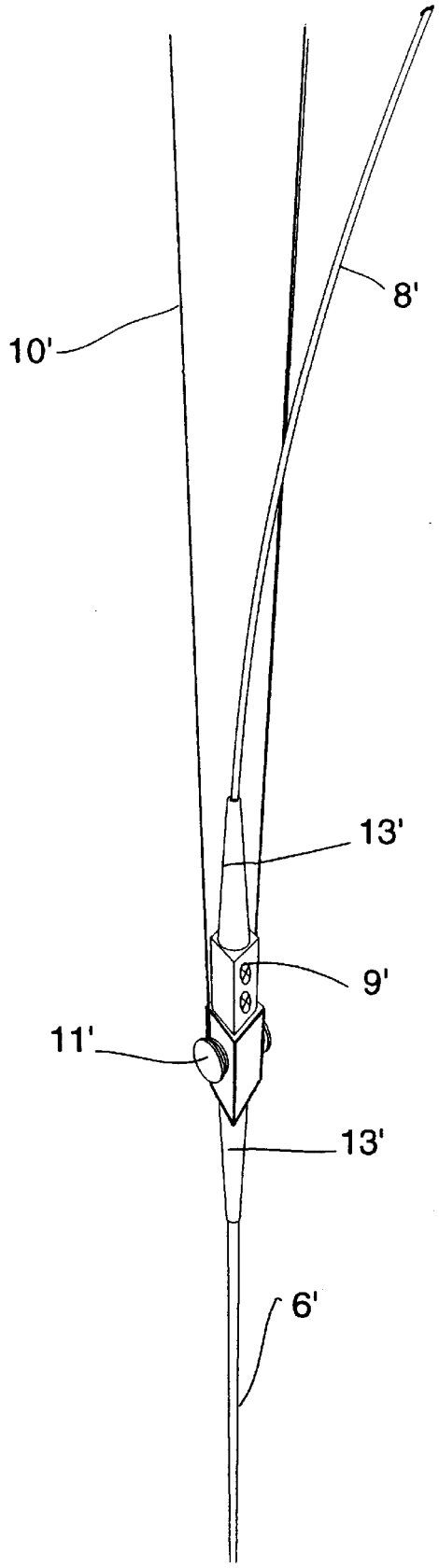
FIG. 5 is a perspective view of a riser system of FIG. 4 showing an enlarged view of the connection between the first and second riser sections.
Figure 6:
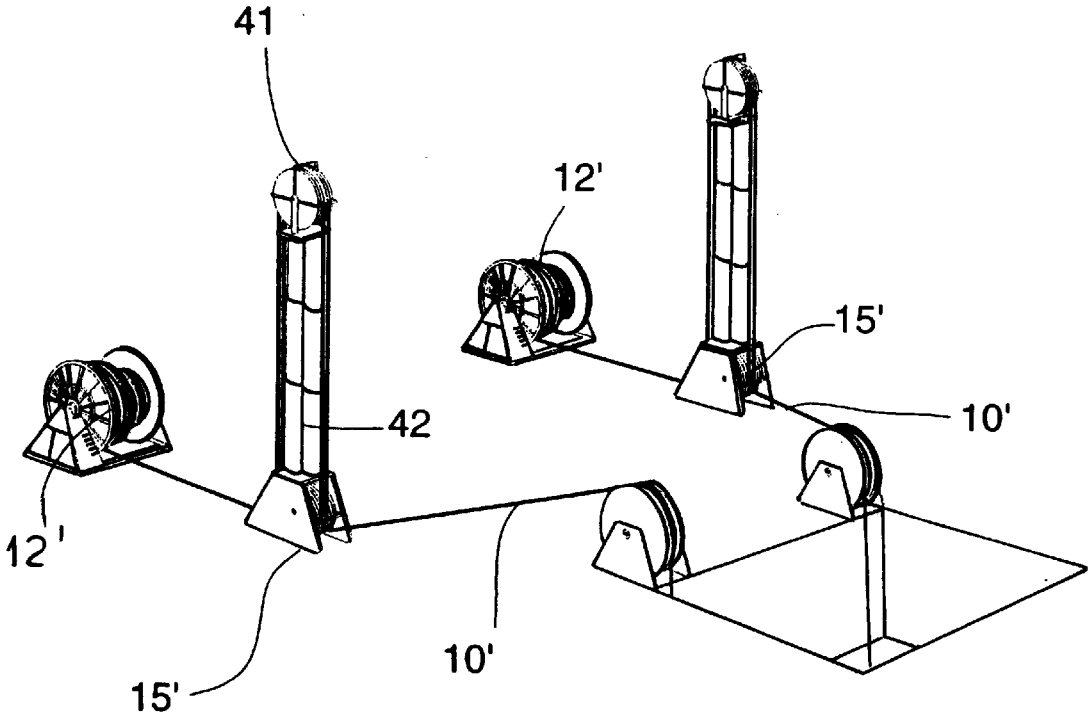
FIG. 6 is a perspective view of the constant load tensioning means.

Referring now to FIGS. 4 to 6 a further preferred embodiment is shown with the corresponding components marked with the same identifying numbers followed by a prime. The riser system comprises a first riser section 6' which extends vertically and is essentially straight and a second flexible riser section 8' which is flexible is arranged above the first rigid riser 6' and flexes to accommodate movements in the surface vessel 4' . There are two tension wires 10' which are connected to the upper end of the lower riser section 6' by means of an anchoring means, such as a trunnion block 11' and at the vessel 4' are connected to a constant load tensioning means 15' and a winch 12'. At the junction between the upper riser 8' and the lower riser 6' a valve block 9' is provided which comprises an emergency shut off valve which automatically closes in the event that the upper riser becomes separated from the lower riser section 6'. Bend stiffeners 13' may be provided immediately above and below the valve block 9' on the upper and lower riser sections 8', 6' to prevent undesirable bending of the riser sections at the junctions with the valve block 9'.

In FIG. 6 the arrangement of the equipment on the deck of the surface vessel 4 is shown in more detail. Each of the two tension wires 10' is connected to a constant load tensioning means 15' and a winch 12'. Load cells are provided on the constant load tensioning means to measure the load in the tension wires 10' so that the constant load tensioning means 15' can take up or pay out the tension wire until the pre-determined desired load, and therefore tension in the wires, is achieved. The constant load tensioning means may comprise two pulleys 41 which are spaced apart with a piston 42 arranged between them.

Figure 8A:
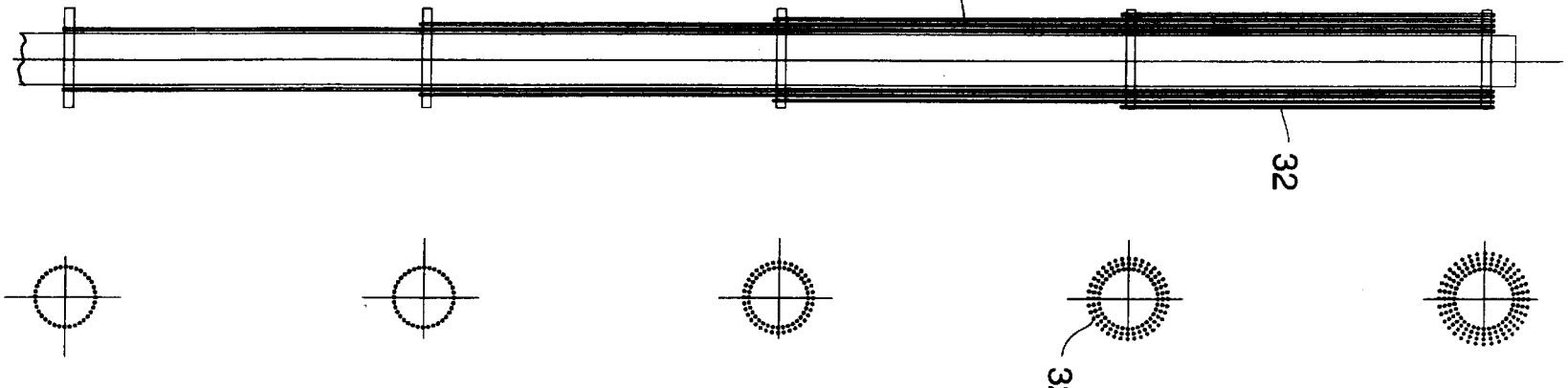
FIGS. 8*a*, and 8*b* show a longitudinal section and cross sections of an alternative embodiment of the flexible riser shown in FIG. 4.
Figure 8B:
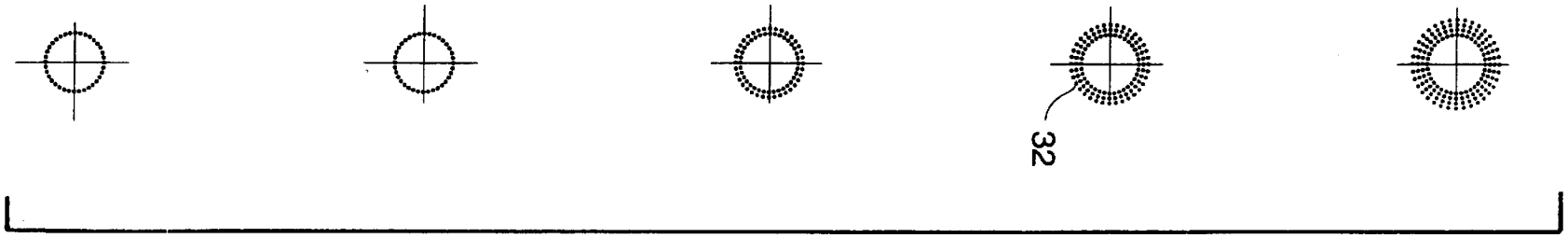

In this embodiment the desired curvature in the upper riser section 8' is induced by variation in the stiffness of the upper flexible riser along its length. This is shown in more detail in FIG. 7. The wall of the riser 8' comprises additional stiffening members 31 extending from the upper end at the vessel which only permit a small degree of bending, and further down the riser 8' the stiffening members 31 stop or reduce in thickness so that a greater degree of bending is permitted. Specifically, in this embodiment twelve stiffening members extend downwards from the top end of the riser. The stiffening members are of varying length, so that whilst three extend down for a particular distance, say to the mid-point of the riser, another three cables run three quarters of this distance, three run to half this distance, and the remaining three extend only a quarter of the distance. The stiffening members' disposition around the circumference of the riser is shown in FIG. 7*b*. Where there are fewer stiffening members of course, the stiffness of the riser will be less. Towards the junction with the first riser are further stiffening members, the bend stiffener above the valve box no longer being required. Thus there is preferably a gradually staged decrease in the stiffness of the riser 8' from the point at which it exits the vessel 4, when in the fully deployed position, reaching a minimum stiffness midway along the riser, the stiffness increasing again down to the junction with the first lower riser. FIG. 8 shows an further embodiment in which the entire thickness of the wall of the riser 6 decreases from the uppermost end downwards (when deployed), by reducing the number of layers 32 from which the riser section is made. The stiffness then will increase with the number of layers present. The layers 32 may be stiffening layers which have be added to a core tube 8". The degree by which the stiffness of the second riser varies along its length will be determined by what stresses it is to endure in particular situations. It may be found, for example, that the stiffness of the second riser at its uppermost end must be greater than that of the lowermost end.

By means of this embodiment of the invention the riser system is self accommodating and it is also possible for long rigid objects to pass through the flexible riser section 8'. The passage of long tools through the flexible riser section 8' is possible in this one aspect of this embodiment by means of a gradual curvature of the flexible riser 8'. As the tools are passed through the flexible riser section 8' they will have the effect of briefly straightening the riser section in the local region of the tool itself, the flexible riser section returning to its original condition immediately behind the tool as it passes through. The flexible riser section is arranged to be long enough to accommodate the movement of the vessel in the water and also be of a sufficiently small curvature to permit long tools to pass through.

Figure 9A:
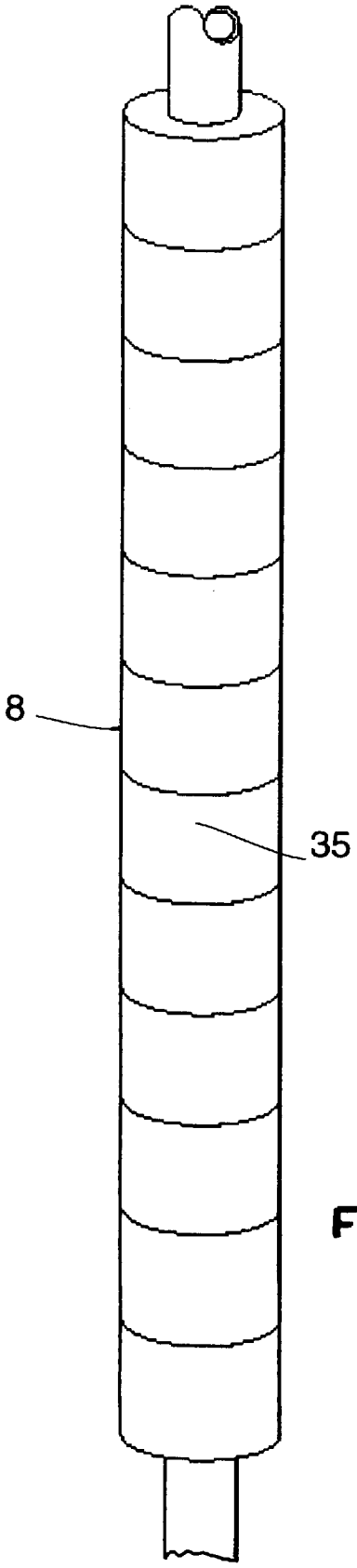
FIGS. 9*a* and 9*b* are perspective views of further embodiments of the flexible riser shown in FIG. 4.
Figure 9B:
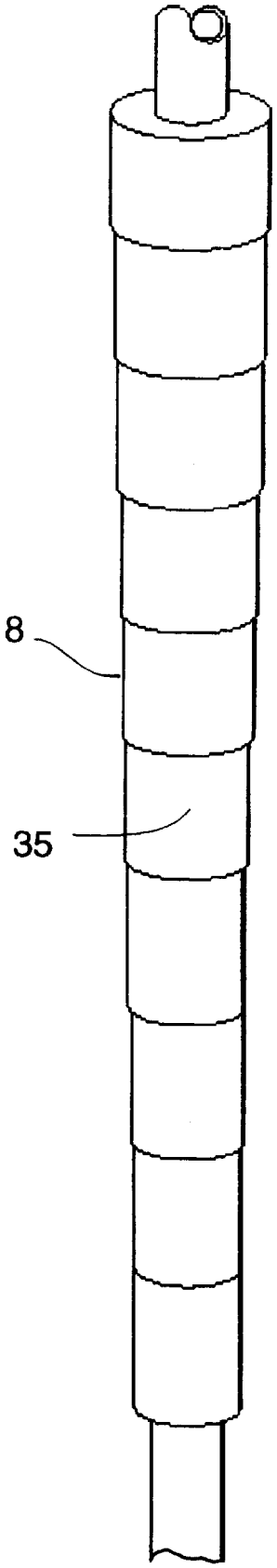

Referring to FIG. 9, varying stiffness along the length of the upper riser may also be achieved by employing collars 35 along the length of the upper riser, these collars being hollow cylindrical members either of the same material, such as steel, but having varying thicknesses as shown in FIG. 9*b*, of a uniform thickness but being made from materials having differing stiffnesses, for example by altering the proportions of the materials' constituent components, as shown in FIG. 9*a*. Such material could be a polymer mix, or a composite employing fibres of different lengths. The collars are then fixed together. FIG. 9 is not drawn to scale—the collars of course can extend the length of the riser, and could be longer than shown here.

It will be appreciated that the riser system according to the invention could be used as an intervention riser to carry out intervention operations in the well by introducing tools and instruments down the center of the riser preferably by means of a narrowing diameter coiled tubing arranged within the riser but also by means of conventional wire lines. It will also be appreciated that the riser system of the present invention can be used as a production riser, as well as for drilling operations.

Figures 10A, 10B:
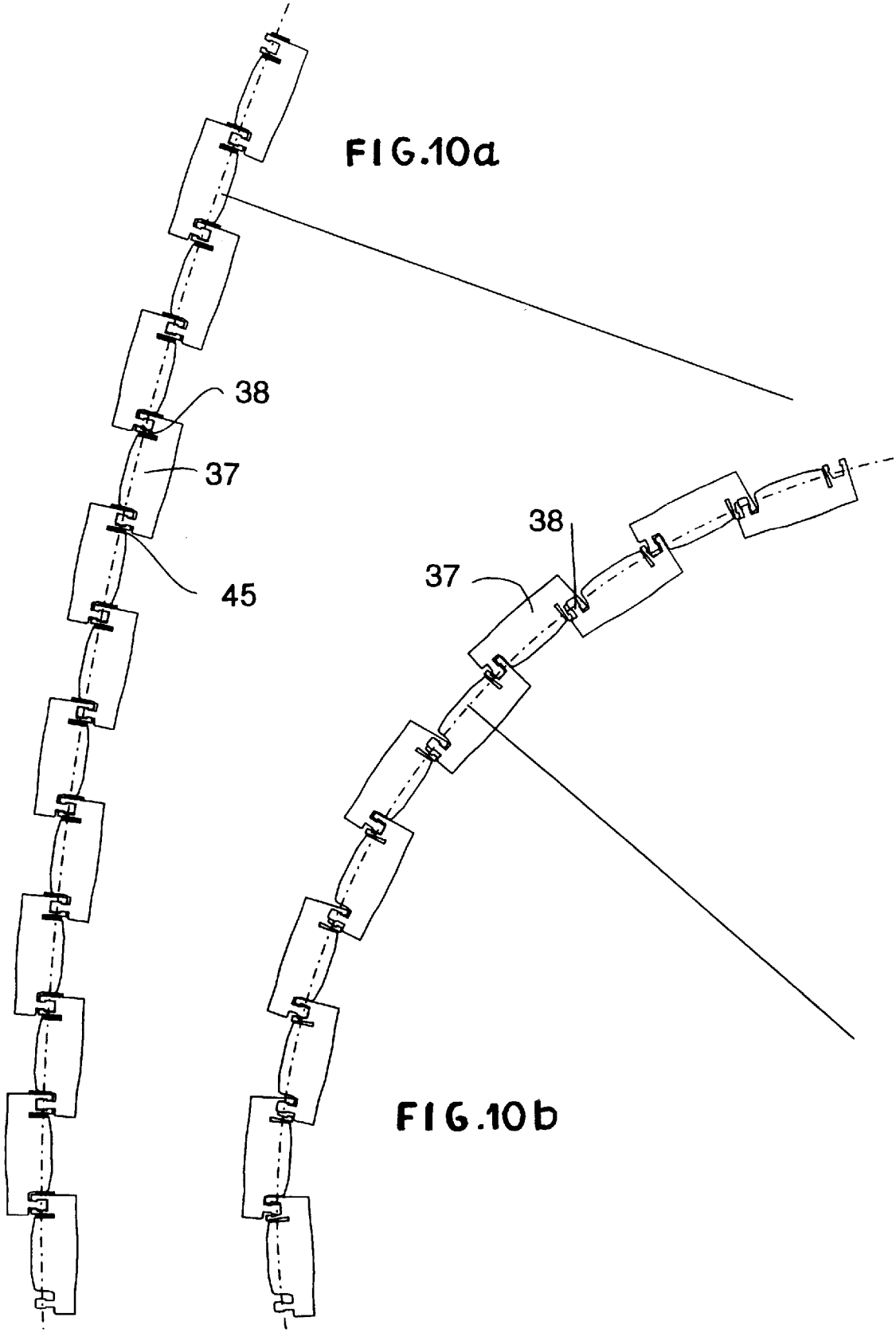
FIGS. 10*a* and 10*b* are elevations of a riser system of the invention showing an enlarged view of the second riser in the region of the vessel.
Figure 11A:
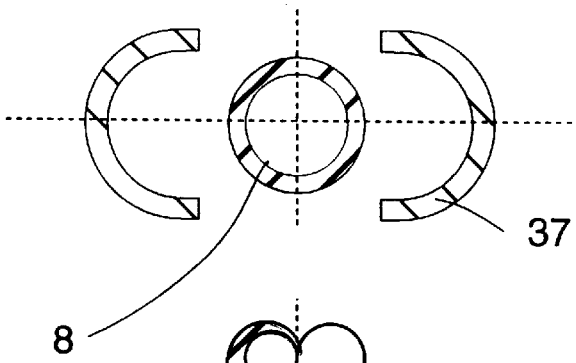
FIG. 11 is an elevation of a riser system of the invention showing a further enlarged view of an embodiment of the curvature limitation means and FIG. 11*a* is a section.
Figure 11:
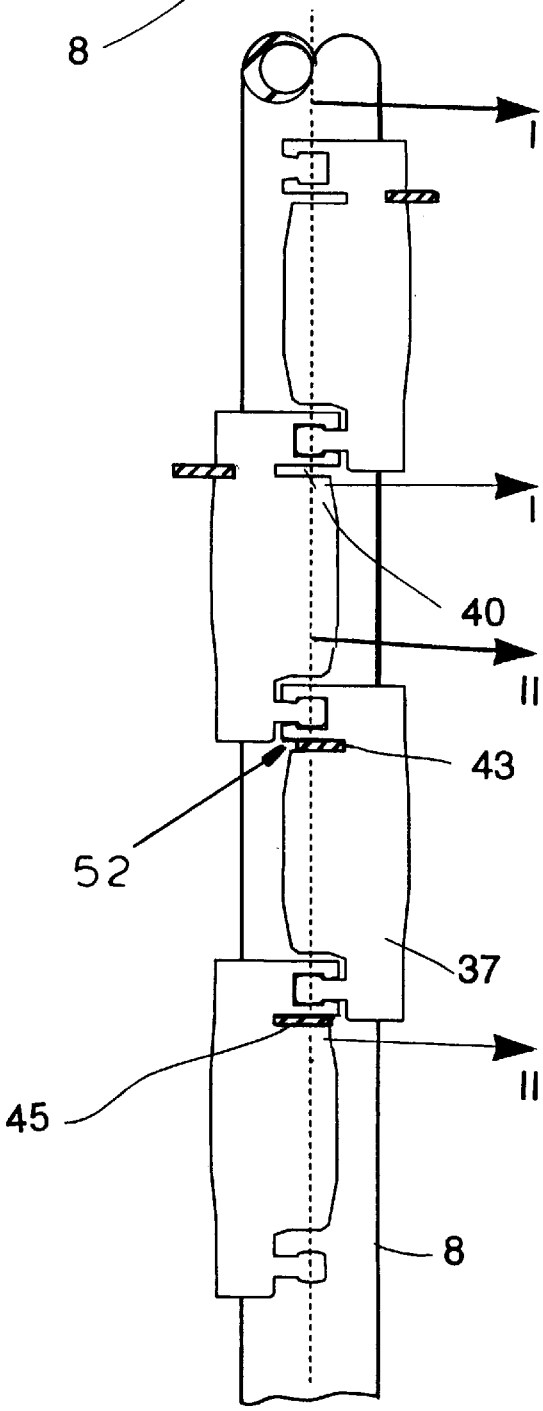

An alternative curvature limiting means, shown in FIGS. 10 and 11, comprises a plurality of discrete collars 37 which are connected together and surround the outer diameter of the second riser 8. The collars 37 are connected together by connection means 38 which permit a limited degree of relative axial movement between adjacent collars 37 which has the effect of controlling the radius of curvature of the second riser section 8.

The curvature control means of the second riser section has two states, a first state in which the second riser section is permitted to bend sufficiently to be wound on a reel as shown in FIG. 10*b*, and a second state in which the second riser section is permitted to bend only to a lesser extent during deployment as a riser as shown in FIG. 10*a*.

Thus activation means are provided on the vessel to convert the second riser section from the first state to the second state as the riser is unreeled from a reel. It can be seen from FIG. 10 that the radius of curvature of the second riser is limited once it exits the reel 16. Referring again to FIG. 10, each collar has a corresponding tongue and groove connection means 38 which links it to the adjacent collar. Alongside each groove each collar has a slot 40. In the unlimited state for reeling the riser onto the reel the groove is left open and the connection means 38 permit greater axial movement of the respective collars by compression of the slot 40. In the curvature limited state for deployment the slot 40 is locked open by locking means 52 which prevent any compression of the groove and thus prevent any additional axial movement of the respective collars.

Figure 12:
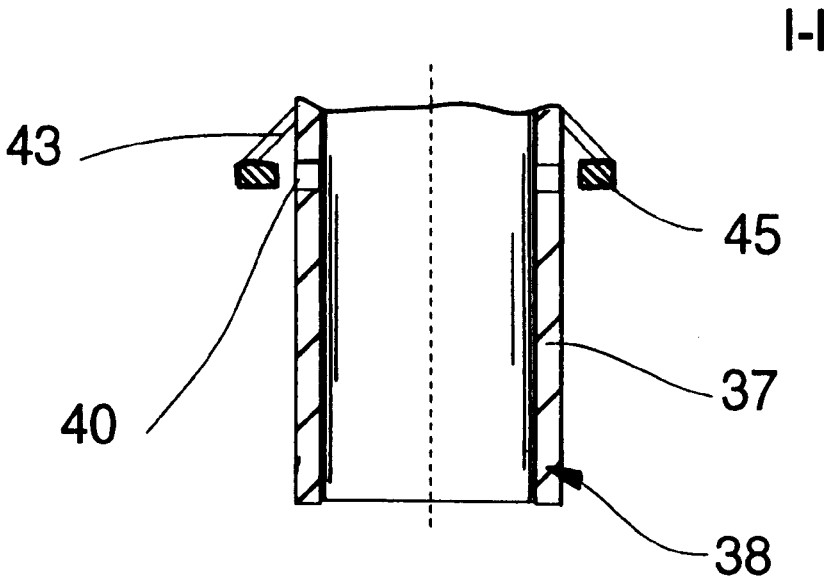
FIGS. 12 and 12*a* are enlarged sectional views of an activation means for the curvature limitation means.
Figure 12A:
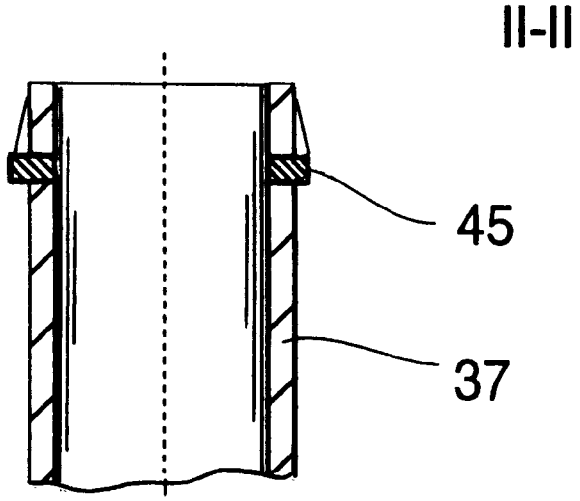

The locking means 52 can be engaged or activated by any suitable means and in this embodiment as shown in FIGS. 11 and 12 they are in the form of a horseshoe shaped clip 43 comprising two arms 45 surrounding the collars 37. The clip 43 has an outward position as shown in the upper collar 37 in FIGS. 11 and 12, in which it is retained by detents (not shown). The two arms 45 of the horseshoe clip 43 are located outside the slots 9 of each collar 37 and the riser is free to bend on to the reel. The clip also has an inward position, as shown in the lower collar 37 in FIGS. 11 and 12 in which the two arms 45 of the clip 43 are engaged in the slots 9 and the more severe bending of the riser is no longer possible. The horseshoe shaped clips 12 are of different thicknesses, the ones disposed in the uppermost collars being relatively thick, and those is lower collars becoming thinner. The upper and lower collars thus limit the curvature of the of the upper riser to a greater extent than those midway along the riser. The upper riser has then, in effect a variable stiffness along its length. Alternatively, the horseshoe shaped clips may be made so as to be compressible to different degrees.

Figure 13A:
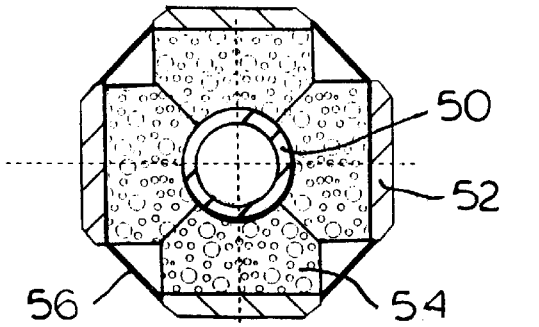
FIG. 13 is a side elevation and FIG. 13*a* a cross section of a further embodiment of the second riser.
Figure 13:
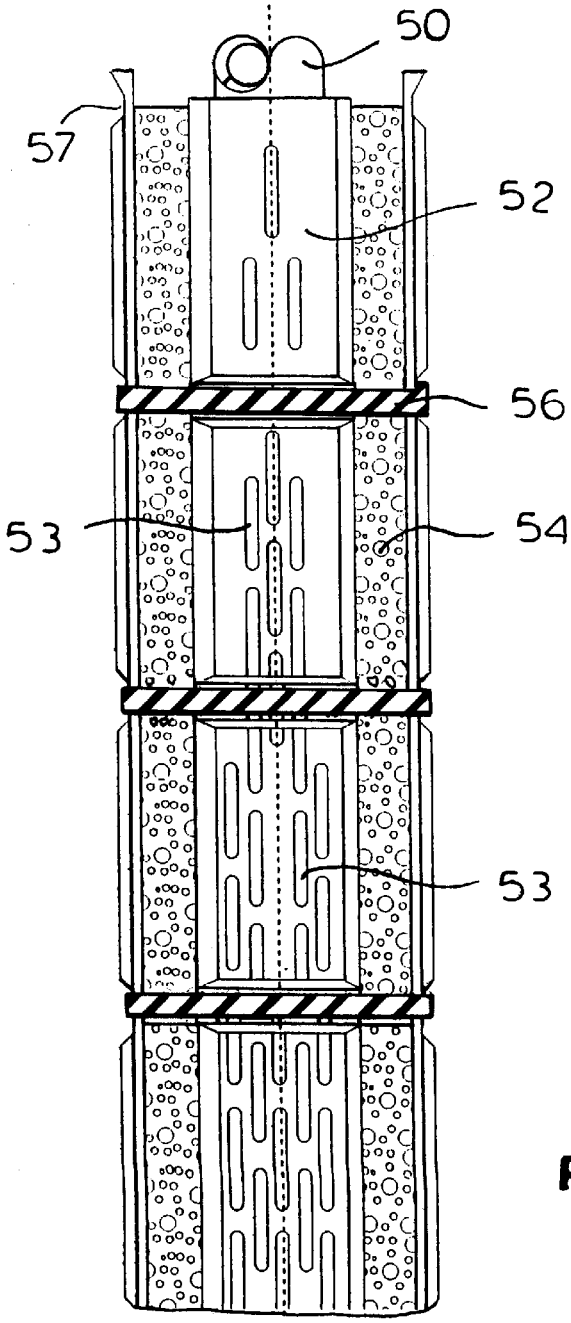

FIG. 13 shows part of a further embodiment of a riser having variable stiffness. A tube 50 is surrounded by foam elements 54 which give the riser buoyancy. The foam 54 elements are protected by titanium plates 62, these plates being secured to the tube 50 by a series of straps 56 disposed along the length of the tube. The titanium plates 52 have horizontal slits 53 incised in them, which determine the stiffness of the plates, and so the stiffness of the whole riser. The uppermost plates 52 have comparatively few slits 53, and are more rigid than plates attached further down the riser which feature more slits and are so more flexible.

Figure 14:
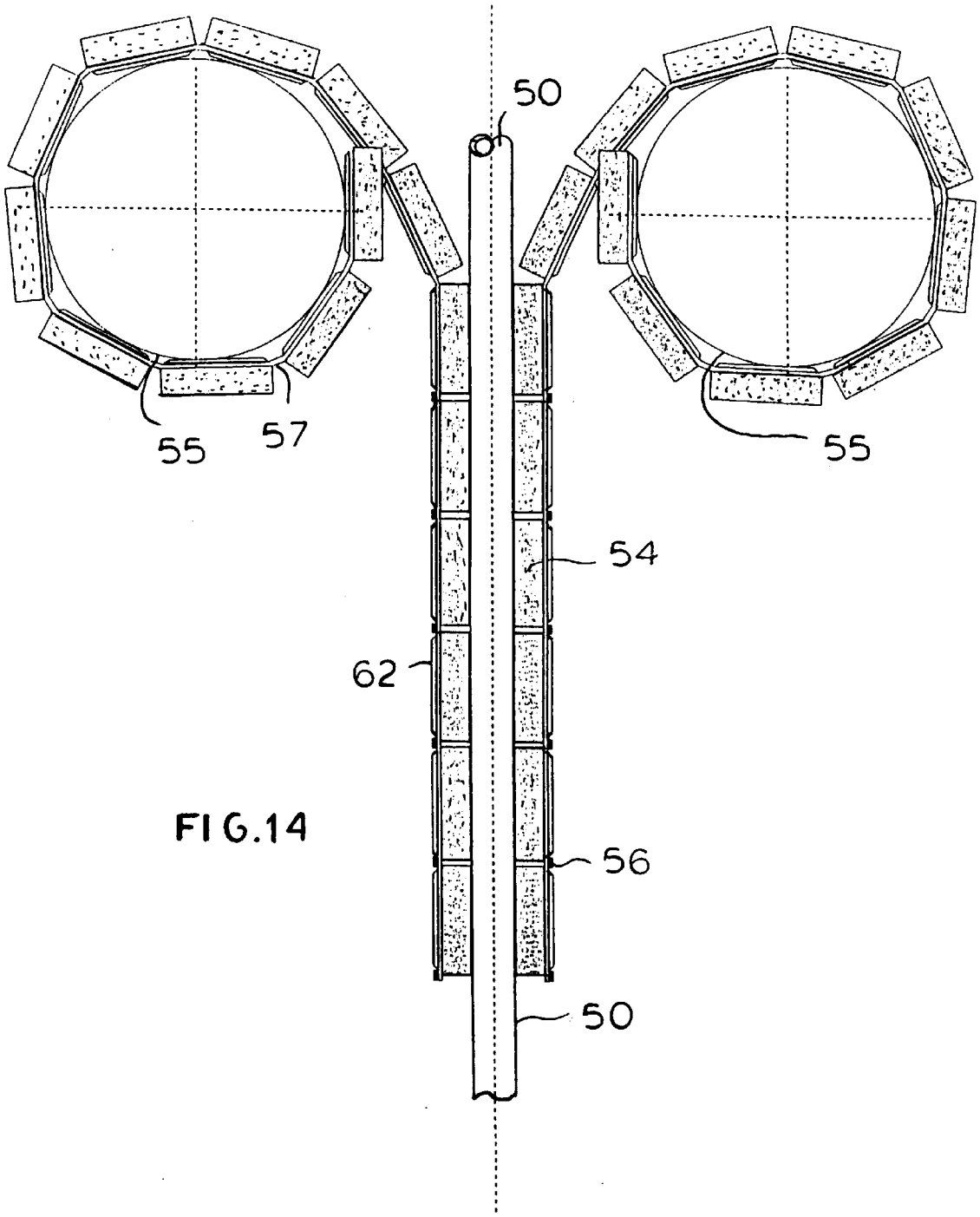
FIG. 14 is a side elevation of this embodiment being deployed.

The foam elements 54 and their associated plates 52 and applied to the tube 50 in so the form of a cross, with four foam elements surrounding the tube. The plates 52 and the foam elements 54 joined to the plates and foam elements above and below by a strip 57 of flexible material, so that the foam elements and plates are joined in a line by these hinges. Referring to FIG. 14, to apply the foam elements and plates to a tube, four such strips 57 are deployed from reels 55 (of which only two are shown) so as to surround the tube, and then the strips are secured to the tube by straps 56 between the plates 52. The four lines are arranged around the tube at ninety degree intervals.

Alternative embodiments using the principles disclosed will suggest themselves to those skilled in the art, and it is intended that such alternatives are included within the scope of the invention, the scope of the invention being limited only by the claims.

What is claimed is:

1. An offshore oil or gas well riser system which forms a connection between the well head and a surface vessel, the riser system comprising a first riser section which extends substantially vertically and is maintained vertically under tension, and a second riser section which is flexible and is arranged above the first riser section and flexes to accommodate movements in the surface vessel, the second riser section including a plurality of curvature limitation means to limit the extent of the curvature of the second riser section, the curvature limitation means having two states, a first state in which the second riser section is permitted to bend to be wound on a reel and a second state in which the second riser section is permitted to bend to a lesser extent and within its elastic limit.

2. A riser system according to claim 1 wherein the first riser section is maintained vertically by a tension cable which is attached to a constant load tensioning means mounted on the vessel.

3. A riser system according to claim 2 wherein two tension cables are provided, the lower ends of which are pivotally connected on either side of an anchoring means at the upper end of the first riser section.

4. A riser system according to claim 1 wherein an emergency disconnect valve is provided between the first riser section and the second flexible riser section.

5. A riser system according to claim 1 wherein the curvature limitation means are provided by a plurality of discrete collars which are connected together and surround the outer diameter of the second riser section.

6. A riser system according to claim 5 wherein the collars are connected together by connection means which permit a limited degree of relative axial movement which controls the radius of curvature of the second riser section.

7. A riser system according to claim 1 wherein the second riser section is changed from the first state to the second state as the riser is unreeled from the reel.

8. A riser system according to claim 1 wherein the second riser section is de-changed from the second state to the first state as the riser is reeled to the reel.

9. A riser system according to claim 1 wherein the collars provide variable stiffness along the length of the second riser section.

10. A riser system according to claim 9 wherein the stiffness of the second riser section decreases with the distance from the vessel along the second riser section.

11. A riser system according to claim 9 wherein the collars vary in thickness.

12. A riser system according to claim 9 wherein the collars are made of materials having a varying stiffness.

13. A method of installation of a well riser system which comprises the steps of;

a. positioning a vessel approximately over a well head in which well intervention operations are required to be carried out;

b. lowering a first lower riser section towards the well head;

c. connecting a second flexible upper riser section to the upper end of the first lower riser section to form a continuous riser;

d. connecting the first lower riser section to a support line at its upper end and lowering the first lower riser section further to the well head and connecting it thereto e. activating curvature limitation means on the second riser section from a first state in which the second section is able to be wound on the reel to a second state in which the curvature is limited to bend to lesser extent and within its elastic limit.

14. A method of passing long objects through a riser system which comprises a connection between a well head and a surface vessel, the riser system comprising a first riser section which extends substantially vertically and is maintained vertically under tension, and a second riser section which is flexible and is arranged above the first riser section and flexes to accommodate movements in the surface vessel, the second riser section including a curvature limitation means which limits the extent of the curvature of the second riser section, the curvature limitation means having two states, a first state in which the second riser section is permitted to bend to be wound on a reel and a second state in which the second riser section is permitted to bend to a lesser extent and within its elastic limit, the method comprising the steps of:

passing a long object through the second riser section while it is maintained straight, and de-tensioning the first riser section such that it operates to accommodate the rise and fall of the vessel in the water, and passing the long object through the first riser section while it is maintained straight during which time the second riser section operates to accommodate the rise and fall of the vessel.

* * * * *